US005879234A

United States Patent [19]

Mengual

[11] Patent Number: 5,879,234

[45] Date of Patent: Mar. 9, 1999

[54] SECURITY SYSTEM FOR REEL TYPE SLOT MACHINE WITH PHYSICAL MAPPING TO CONTROL THE WIN ODDS

[75] Inventor: Antoni Mengual, Barcelona, Spain

[73] Assignee: Universal de Desarrollos Electronicos, S.A. (UNIDESA), Barcelona, Spain

[21] Appl. No.: 942,064

[22] Filed: Oct. 1, 1997

[51] Int. Cl.[6] ..... G07F 17/34

[52] U.S. Cl. ..... 463/20; 463/21; 463/24; 463/29; 273/143 R

[58] Field of Search ..... 463/20, 25, 29, 463/24, 21; 273/143 R

[56] References Cited

U.S. PATENT DOCUMENTS

| | | | |
|---|---|---|---|
| 4,071,246 | 1/1978 | Hooker | 273/143 R |
| 4,095,795 | 6/1978 | Saxton et al. | 273/143 R |
| 4,273,334 | 6/1981 | Schone et al. | 273/143 R |
| 4,299,388 | 11/1981 | Resch et al. | 273/143 R |
| 4,421,310 | 12/1983 | Williams | 273/143 R |
| 4,448,419 | 5/1984 | Telnaes | 273/143 R |
| 4,515,366 | 5/1985 | Hamano | 273/143 R |
| 4,607,844 | 8/1986 | Fullerton | 463/24 |
| 4,687,981 | 8/1987 | Okada | 318/696 |
| 4,772,022 | 9/1988 | Yoshitomi | 273/143 R |
| 4,790,537 | 12/1988 | Smyth et al. | 273/143 R |
| 4,795,155 | 1/1989 | Grande | 273/143 R |
| 4,912,389 | 3/1990 | Eguchi | 318/696 |
| 5,050,881 | 9/1991 | Nagao | 273/143 R |
| 5,058,893 | 10/1991 | Dickinson et al. | 273/143 R |
| 5,085,436 | 2/1992 | Bennett | 273/143 R |
| 5,102,134 | 4/1992 | Smyth | 273/138.2 |
| 5,102,137 | 4/1992 | Ekiert | 273/143 R |
| 5,108,099 | 4/1992 | Smyth et al. | 273/143 R |
| 5,154,421 | 10/1992 | Hamano | 273/138.2 |
| 5,169,147 | 12/1992 | Hamano | 273/143 R |
| 5,209,479 | 5/1993 | Nagao et al. | 273/138.2 |
| 5,219,167 | 6/1993 | Hamano | 273/143 R |
| 5,224,707 | 7/1993 | Martin | 273/143 R |
| 5,263,716 | 11/1993 | Smyth | 273/143 R |
| 5,380,008 | 1/1995 | Mathis et al. | 273/143 R |
| 5,423,540 | 6/1995 | Taxon | 273/143 R |
| 5,423,541 | 6/1995 | Nicastro et al. | 273/143 R |
| 5,456,465 | 10/1995 | Durham | 273/138.2 |
| 5,511,784 | 4/1996 | Furry et al. | 273/143 R |
| 5,569,084 | 10/1996 | Nicastro et al. | 463/20 |

*Primary Examiner*—Benjamin H. Layno
*Attorney, Agent, or Firm*—McDonnell Boehnen Hulbert & Berghoff

[57] ABSTRACT

The present invention relates to security system for a gaming apparatus and method for its operation. It further relates to a gaming apparatus incorporating an electronic security system. The gaming apparatus includes one or more physical displays that rotate about at least one axis. These displays are physically associated with a mechanism that controls the odds of the reel stopping at any particular reel position in such a manner that the probability of stopping at least one position differs from the probability of stopping at least one other position. The security system provides a safeguard against unauthorized alteration of the machine parameter that could effect its outcome. The present invention is particularly appropriate for application in slot machines.

23 Claims, 6 Drawing Sheets

SECURITY SYSTEM FOR REEL TYPE SLOT MACHINE WITH PHYSICAL MAPPING TO CONTROL THE WIN ODDS

BACKGROUND OF THE INVENTION

The present invention relates to a security system for a gaming apparatus and more particularly for reel type slot machines. In particular, the present invention relates to security systems that prevent tampering with reel type slot machines wherein the win odds of a combination can be lowered and thereby allowing for greater pay outs.

Historically, reel type slot machines were comprised of multiple reels that rotated about an axis and stopped randomly. In such machines the odds of the reel stopping on any particular reel position were the same as it stopping at any other position. Thus, the odds were set by the physical structure of the machine and there was little need for security against tampering with the machines.

With the advent of computer technology, electronic slot machines were designed. Initially, the electronic slot machines did not employ reels. Rather, these machines utilized a video screen to simulate a reel. These machine were of limited commercial success.

Eventually, electronic reel-type machines were developed. These machines removed the game from the reels and played the game in a microprocessor. The reels became simply a method of displaying the results of the game. Such a machine is taught in U.S. Pat. No. 4,095,795. In these machine "virtual reels" are represented by random number generators in a microprocessor. The random number generators generate a number and that number corresponds to a reel position on the physical reel. In other words, the numbers of the random number generators are mapped to the physical reel positions. Initially, these virtual reel machines generated one number for each position on the reel, thus there was a direct mapping and the odds were not changed. Subsequently, the concept of many to one mapping was introduced and it allowed the odds associated with virtual reel machines to be adjusted. See U.S. Pat. No. 4,448,419. These machines use random number generators to generate numbers from a range of numbers that exceeds the number of physical reel combinations. These numbers are mapped to certain reel combinations with multiple numbers being mapped to some combinations. In this manner, the odds of displaying some combinations will exceed the odds of displaying other combinations thereby allowing for higher payout odds. These machines also introduced the real danger that the machine could be tampered with and the odds adjusted without authority through electronic manipulation.

SUMMARY OF THE INVENTION

There remains a need for a slot machine wherein the odds can be lowered and the parameters of the machines can be easily altered and at the same time there be a security system preventing unauthorized adjustment of the parameters of the machine.

There is further a need for a slot machine wherein the total pay out of the machine and the pay schedule of the machine are protected by a security system preventing unauthorized alteration but without the need for special expertise.

Therefore, it is an object of the present invention to provide a security system for a reel type slot machine wherein unauthorized alteration of the parameters of the machine results in rendering the machine unplayable.

It is a further object of the present invention to provide a reel type slot machine where the odds of the machine can be altered but only upon entry into a special recognition mode and such mode is security protected.

It is still a further object of the present invention to provide a reel type slot machine that has a predictable pay out schedule that is easily adjustable and is secure from unauthorized alteration.

The present invention is an improvement on the gaming device described in a U.S. patent application Ser. No. 08/852,636 filed on May 7, 1997.

Accordingly, the present invention relates to a gaming apparatus that includes one or more physical reels that rotate about a central axis. These reels are associated with a mechanism that physically controls the odds of the reel stopping at any particular reel position in such a manner that the probability of stopping at least one reel position differs from the probability of stopping at least one other reel position. This mechanism is physically associated with the rotation of the reels. The mechanism is further used to store odds information on a read/write device when the machine is put in a special recognition mode. This stored information is then used to periodically check the machine to make sure the machine has not been altered.

More specifically, the gaming machine of the present invention includes a mechanism for controlling the probability that any particular reel stop position is displayed on the win line. One such mechanism employs an optical marker containing value information. An optical marker is physically associated with each reel stop position. A mechanism for reading the value information contained on the optical marker is provided. These read values are then summed by a summing mechanism such as a microprocessors until a target sum is reached. A random number generator generates the target sum. In operation of the gaming machine, the reel stop position at which the sum of the value information reaches the target sum is selected and the associated indicia is displayed on the win line. The optical mechanism is further used to store the odds information when the machine is in a special recognition mode. The stored information is periodically compared the actual odds of the machine as operating. This comparison can be done constantly or at the occurrence of certain events. If a discrepancy between the stored information and the actual information is found the machine will cease to operate until the discrepancy is corrected.

In addition, the present invention relates to a method for securing the operation of a gaming machine including the following steps: (1) putting the machine in a special recognition mode; (2) storing the odds information in a read/write device; (3) exiting the special recognition mode; and (4) monitoring the operation of the machine to confirm that the parameters of the machine are consistent with the stored information.

Other objects features and advantages of the invention will be readily apparent from the following description of certain preferred embodiments thereof taken in conjunction with the accompanying drawings, although variations and modifications may be effected without departing from the spirit and scope of the novel concepts of the disclosure.

DESCRIPTION OF THE PREFERRED EMBODIMENTS

Figure 1:
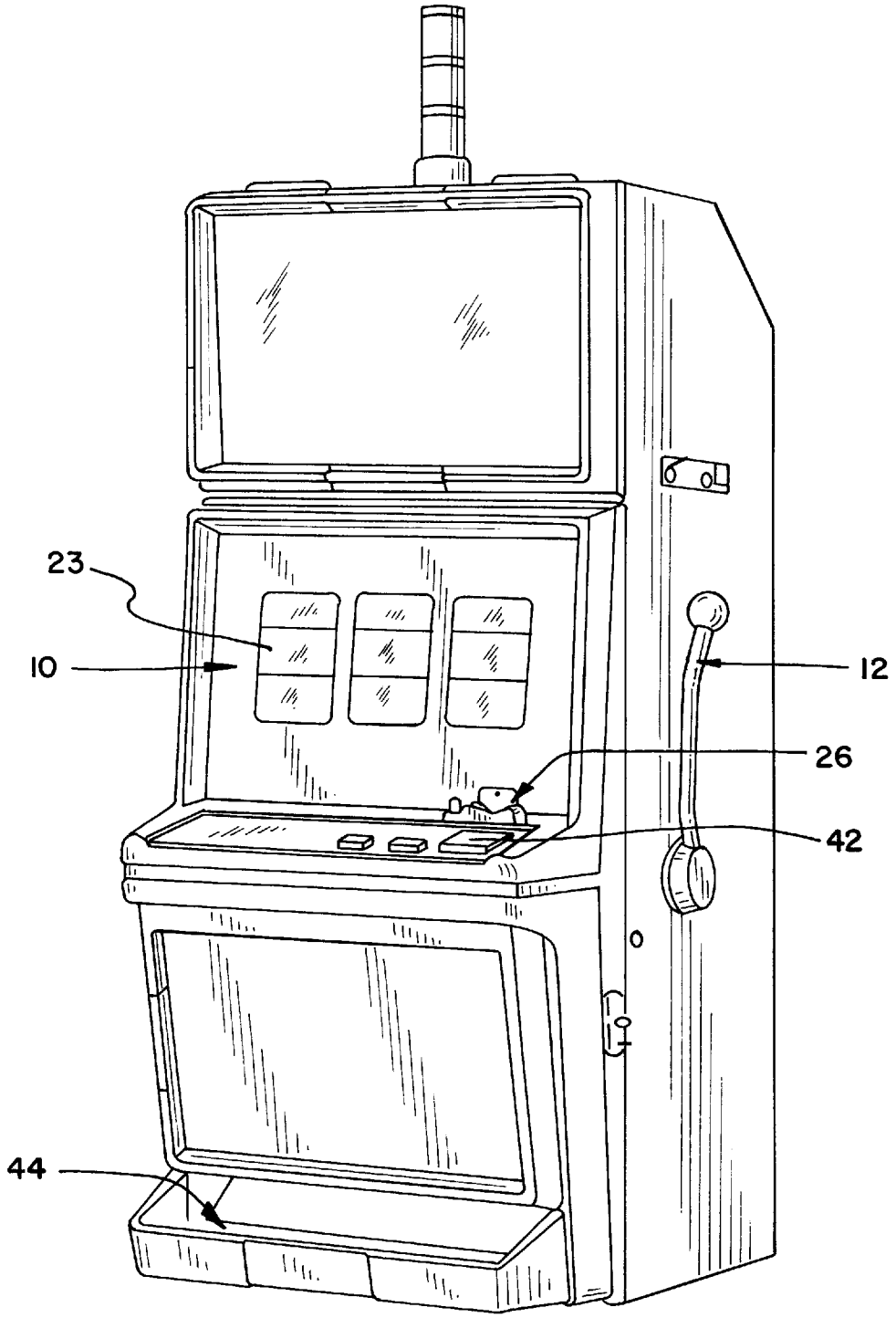
FIG. 1 illustrates a perspective view of a typical slot machine.
Figure 2:
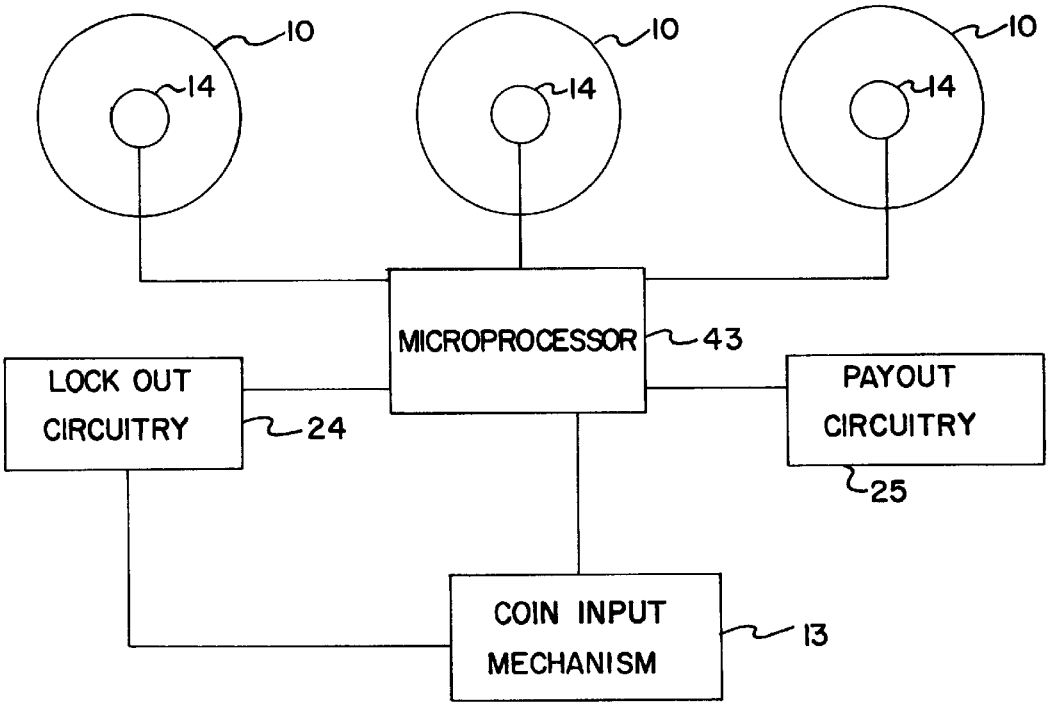
FIG. 2 is a block diagram illustrating the operation of a typical slot machine.

FIGS. 1 and 2 illustrate the structure and operation of a typical gaming machine in use today. The present invention utilizes many of the same operational features each of which are well know to those skilled in the art. The machine of the present invention uses conventional structure to initiate the rotation of the reels 10. Generally, the machine has three reels 10. However, the number of reels 10 can vary from game to game and can be as few as one to as many as the game designer desires. Each of the reels include a series of indicia 18 (see FIG. 5A) located on the outer periphery 20 of the reel 10. Each indicia 18 is associated with a reel stop position 22, such that when the reel 10 stops at the particular reel stop position 22, the associated indicia 18 is visible to the player on a win line 23. While physical reels are preferred the present invention could also be applicable to machines that use a rotating tape or similar structures.

The game is initiated by the insertion of coins or tokens into a coin slot 26. The coins activate a coin input mechanism 13 that then releases a lockout mechanism 24. Prior to the insertion of the coins the lockout mechanism 24 prevents the game from being played. Such lockout mechanisms are well known in the art. Once the lockout mechanism 24 is released, the reels 10 are free to rotate. The reels 10 are set in motion by a player. Typically, this accomplished by pulling on a handle 12 or pushing a button 42. This activates the reel drive mechanism 14, which in turn rotates the reels 10. Such reel drive mechanisms are well known in the art. A preferred reel drive mechanism is comprised of a series of step motors, with a separate step motor associated with each reel 10. The step motors allow the reel 10 to be stopped in distinct reel stop positions 22. Any appropriate reel drive may be used and still be within the scope of the present invention.

The game of the present invention also includes a mechanism for activating the pay out circuitry 25 once the reels have stopped. Such mechanisms are well known in the art. Typically they include a detecting means such as a sensor [not shown] that identifies the reel position. This sensor provides information to a microprocessor 43, which then compares the sensed information to a payout table. The microprocessor 43 then activates a hopper which dispenses a appropriate pay out into a bin 44.

Figure 3:
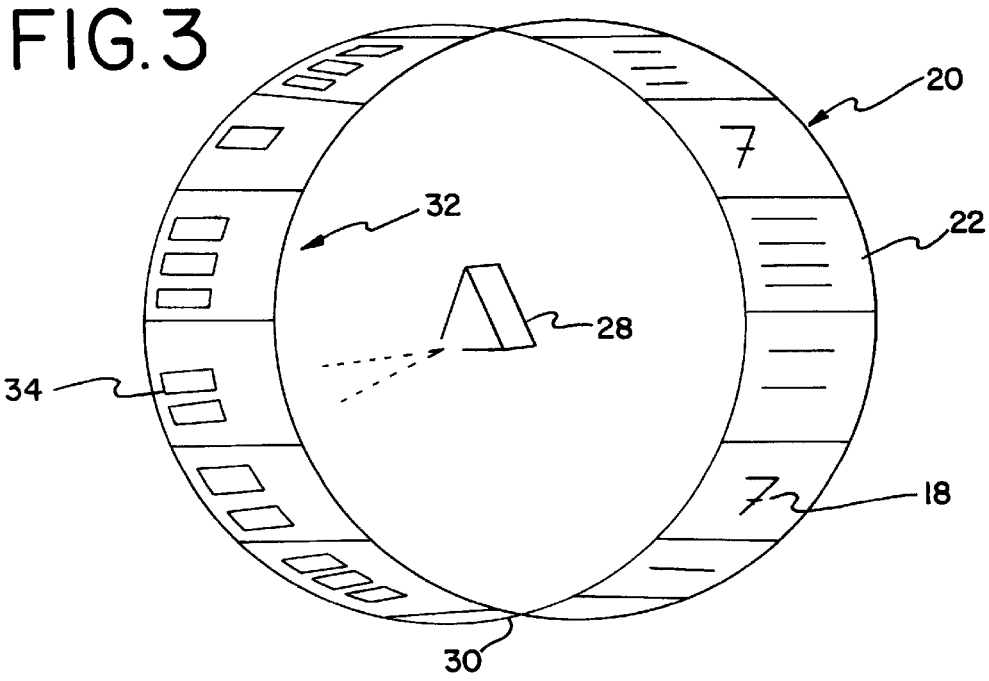
FIG. 3 is a representation of a reel in a first preferred embodiment of a slot machine used with the present invention.
Figure 4:
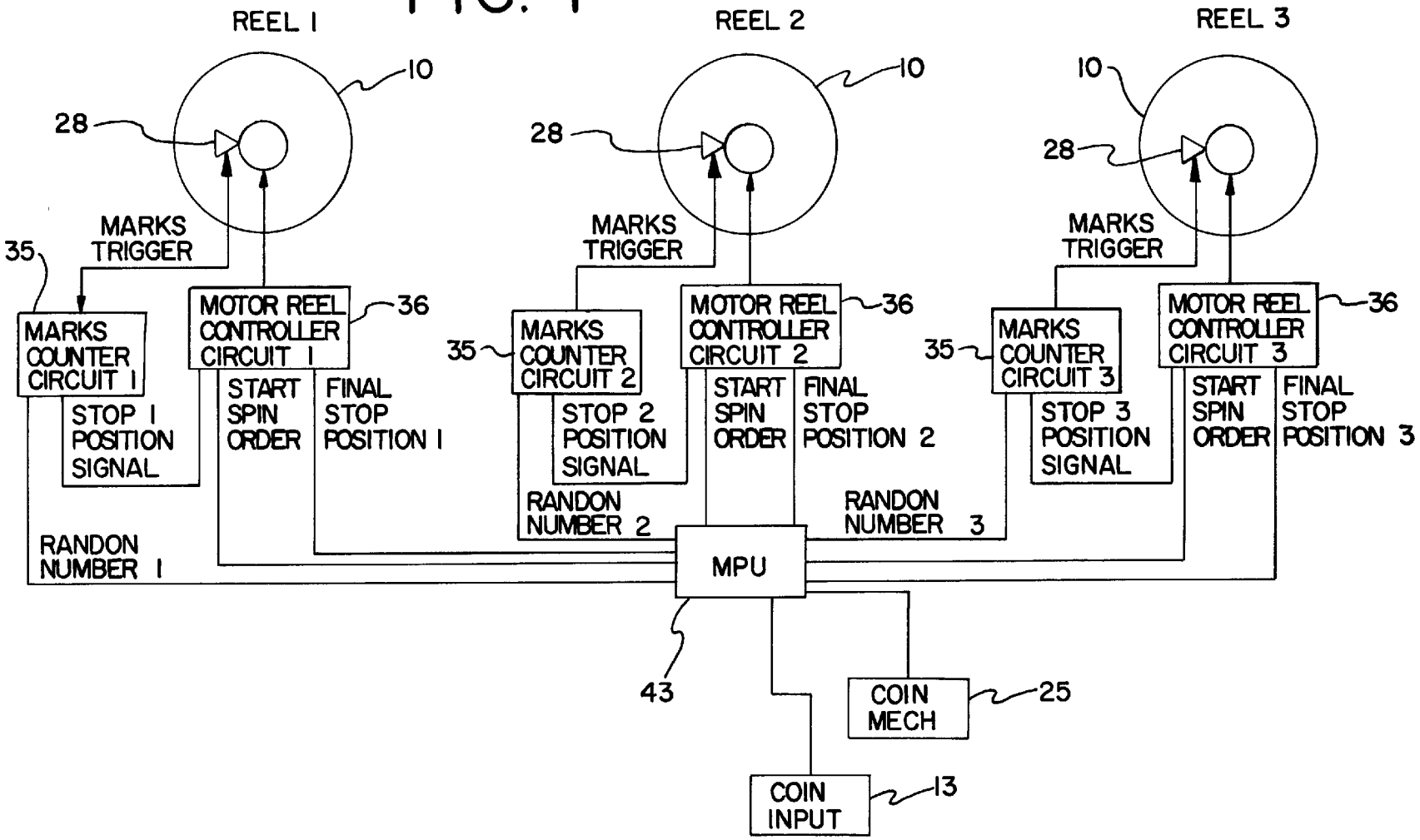
FIG. 4 is a block diagram illustrating the operation of a preferred embodiment of a slot machine used in the present invention.

A first preferred embodiment of the present invention is illustrated in FIGS. 3 and 4. In this embodiment the slot machine includes an optical sensor 28. The optical sensor 28 is positioned in the inner circumference of the reel 10. A removable strip 30 is located on the reel 10. On the removable strip 30 is located a series of optical markers 34 that are readable by the optical sensor 28 (See FIGS. 5A–5B). The strip 30 is positioned such that one set of markers 34 is associated with each reel stop position 22 and the markers 34 are readable by the optical sensor 28. Each set of markers 34 contains information readable by the sensor 28. This information includes at least a relative value assigned to the reel position. It generally will also include information identifying the associated reel stop position to facilitate stopping the reel at the appropriate location. The optical markers 34 can take many forms. They could simply be a series of readable marks each mark representing an equal increment. Or the marks could be of varying width wherein the width represents a differentiation in the incremental value of the mark. Moreover, the marks can be a binary code or a real number code.

In one especially preferred embodiment the optical markers 34 each represent a single increment. A set of the optical markers 34 is associated with each of the reel stop positions. As each of the markers 34 passes the optical sensor 28 it advances a counter 35 one increment, thus summing the optical marker 34. The counter 35 can be included as part of the microprocessor 43.

In another especially preferred embodiment the optical markers 34 are bar codes and the optical sensor 28 is a bar code reader. Thus, as the reel 10 spins, the optical sensor 28 reads the information on the optical markers 34 as they pass the sensor 28. This allows a microprocessor 43 to sum the relative values on the markers 34 that pass the sensor 28. The summing process can be done at any time after the rotation of the reels 10 has been initiated.

This preferred embodiment includes a random number generator within microprocessor 43. The random number generator generates a number from an appropriate range of numbers. A preferred range is an integer multiple of the total sum of the markers on the reel 10. This number generation is done at an appropriate time, which may be, depending on the specific design, before, after or at the time the rotation of the reels 10 is initiated. The reel stop position 22 at which the values summed by the microprocessor 43 equals the number generated by the random number generator will be the position of the reel 10 that will be displayed to the player on the win line 23. In this embodiment the odds of a particular reel stop position 22 being displayed on the win line 23 are set by the relative values incorporated on the optical markers 34.

Figure 5A:
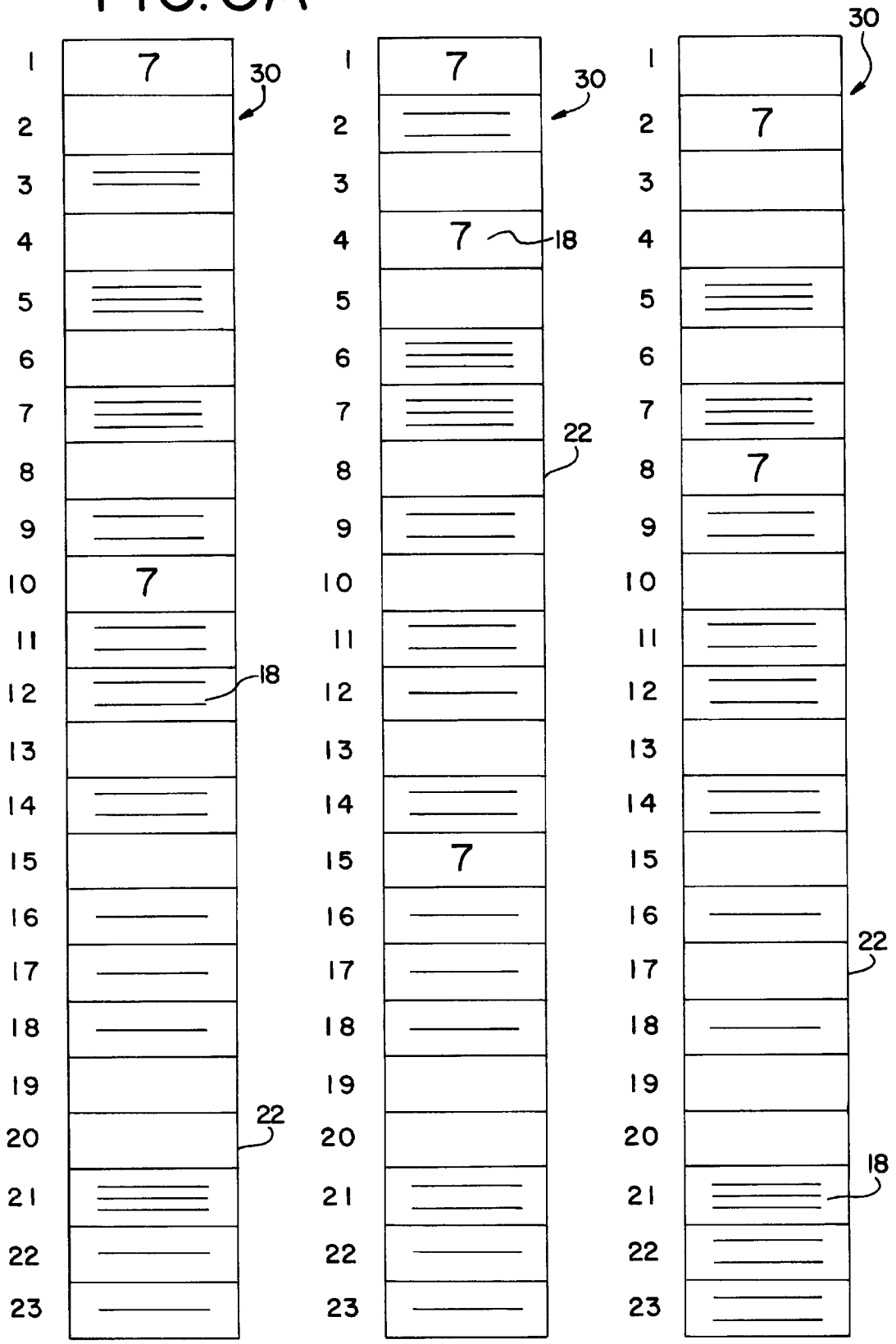
FIGS. 5A–5B illustrate three strips with indicia on one side and the optical markers included in a preferred embodiment of a slot machine used with the present invention.
Figure 5B:
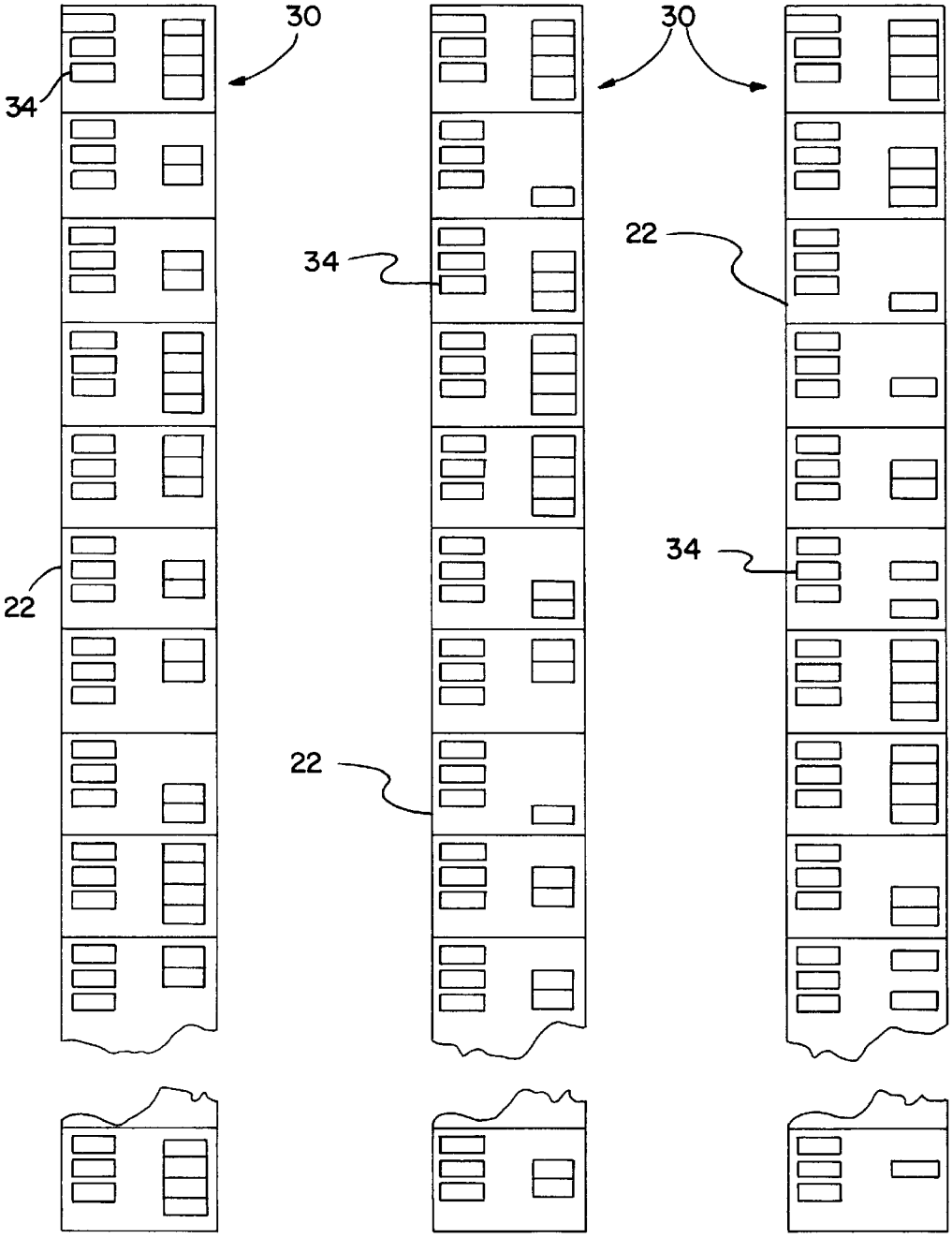

An example of a set of removable strips 30 for a typical three reel machine having twenty four reel positions per reel 10 is shown in FIGS. 5A–5B. This example shows a strip 30 with indicia 18 associated with each reel stop position 22 printed on one side and corresponding optical markers 34 printed on the other side. While use of a single strip 30 with printing on both sides is preferred, separate strips containing the indicia 18 and the optical markers 34 may be used. The optical markers 34 on the strips 30 of FIGS. 5A–5B contain value information for each corresponding reel stop position 22 and identify the corresponding reel stop position 18.

Once the game starts, i.e. the appropriate coins have been inserted and the lockout circuitry 24 has been released, the following tasks takes place for each reel 10:

(1) a random number generator 36 generates a target sum;

(2) a counter/summing circuit 35 is reset to zero and receives the random number generator as the target sum;

(3) a command is sent to the reel drive mechanism 14 to initiate the spinning of the reel 10;

(4) as the reel 10 spins the counter/summing circuit 35 begins counting or summing the values in the optical marks 34 passing the optical sensor 28;

(5) when the summing circuit reaches the target sum, the associated reel stop position is identified and a stop position signal is sent to a motor reel control circuit 36;

(6) the motor reel controller circuit 36 stops the reel 10 at the selected reel stop position 22 and sends a signal to the microprocessor 43 identifying the selected reel stop position 22;

(7) the microprocessor 43 then determines the pay out for the combination of reel stop positions so selected and sends a signal to the coin mechanism to release the appropriate number of coins. The specific timing of the generation of the target sum by the random number generator 36 is not critical. It could be generated before, after, or simultaneously to the initiation of the rotation of the reels 10.

With such a mechanism the control of the odds is straightforward. For example, the total sum of the values on all the optical markers 34 corresponding to each reel stop position may equal one hundred. If a first reel stop position is associated with a set of optical markers 34 with a total value of ten, then the odds of the reel stopping at that position are ten to one. Similarly, if a second reel stop position is associated with a set of optical markers 34 with a total value of one, then the odds of the reel stopping at that position are one hundred to one. Setting the range of random numbers that can be generated as an integer multiple of the total sum of all the optical markers allows the odds of each reel stop location to be selected to be unchanged on consecutive games. Through such a system the physical structure of the machine allows the control of the odds. Such control can be consider "physical mapping" of the win odds.

On a given machine the pay table, i.e., the designation of the winning displays and pay off for each, can be easily adjusted by exchanging the removable strip 30 with another strip on which the optical markers 34 associate different values with each of the reel stop positions 22. Thus, the parameters of the machine can be easily adjusted without having to alter the electronic features of the machine.

Figure 6:
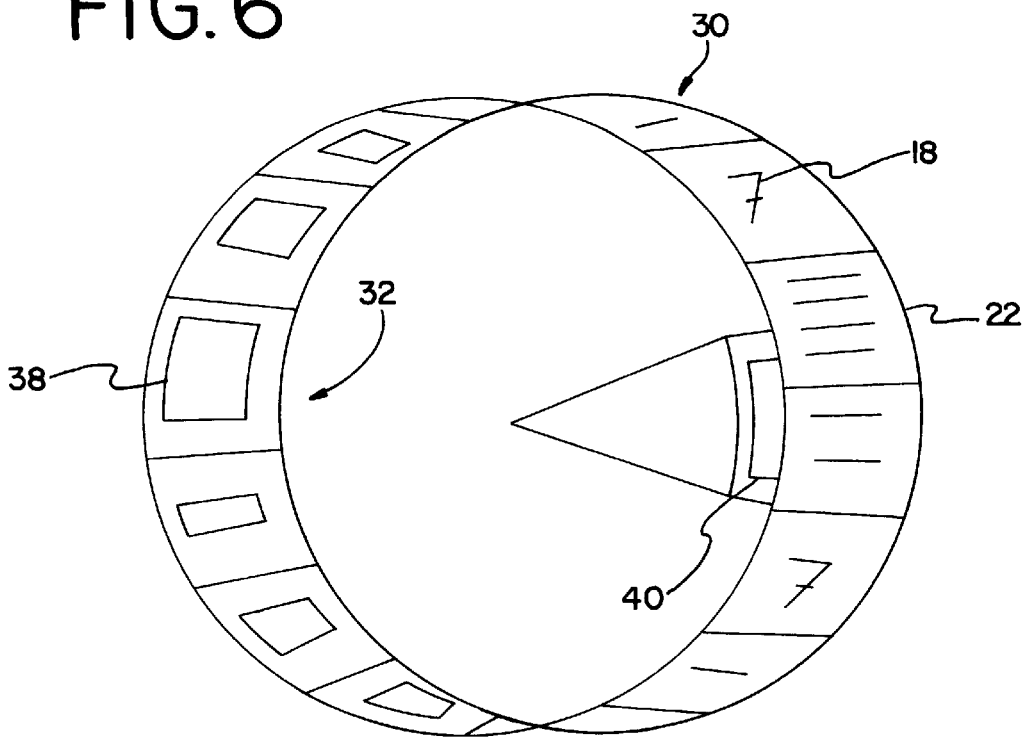
FIG. 6 is a representation of a reel in a second preferred embodiment of the slot machine used with the present invention.

FIG. 6 illustrates a second preferred embodiment of the present invention using physical mapping to adjust the odds associated with the machine. This embodiment uses magnetic control instead of the optical control in the first embodiment. Specifically, on the inner periphery 32 of the reel 10 a series of outer magnets 38 are removably affixed. In this configuration there is an outer magnet 38 associated with each reel stop position 22. The outer magnets 38 are preferably permanent magnets all oriented with the same polarity such that like poles are directed toward the center of the reel 10. The outer magnets 38 are of varying magnetism. For example, if the outer magnets 38 are permanent magnets they will be of different lengths. A fixed magnet 40 is mounted in fixed position in the inner periphery of the reel 10 very close to the path of motion of the outer magnets 38. The fixed magnet 40 is positioned such that its polarity is opposite that of the outer magnets 38, i.e., an opposite pole faces the outer magnets 38 so that they attract each other. In general, it is preferred that the fixed magnet be a permanent magnet of a size greater than the outer magnets 38. Other arrangements are acceptable.

In operation, as the reel 10 rotates the outer magnets 38 move pass the fixed magnet 40. The magnetic attraction between the fixed magnet 40 and the outer magnets 38 creates a breaking torque on the reel 10. This braking torque will result in stopping the reel 10 and displaying a reel stop position 22 on the win line 23. The probability of each reel stop position 22 being the position stopping at the win line 23 will be dependent on the nature of the outer magnet 38 associated with that position. Specifically, the larger the outer magnet 38 the more likely that position will be the stopping position. Thus, the odds of the reel 10 stopping at a particular reel stop position 22 can be controlled by relative size of the outer magnets 38. Because the outer magnets 38 are removably attached to the reel 10, the pay out schedule of a machine can be changed by switching out the outer magnets 38.

Other embodiments of the physical mapping system also fall within the scope of the present invention. Examples of such embodiments will be obvious to those of skill in the art in light the present disclosure. For example, the physical mapping could be implemented with physical ratchet wherein the number of physical ratchet position associated with each reel stop position 22 varies. Each ratchet position advances a counter. Another example may include a series of electrical contacts located on the reel 10 that pass over a fixed contact wherein each time the circuit is connected it advances a counter. In either case, when the counter reaches a number selected by a random number generator, that defines the position 22 that will be displayed on the win line 23.

Now that the preferred embodiment of the underlying gaming machine has been described, attention is turned to the security system and its operation. It should be understood, however, that the present security system while having special application to these preferred gaming machines is not limited to use on those machines and is fully applicable for use on more convention gaming machines.

Gaming machines preferably have certain safe guards to prevent tampering such as altering the odds to either increase or decrease the pay out. In the present invention, before the machine can be serviced or the odds can be changed it must be put into a special recognition mode. In this special recognition mode, the machine reads the odds for each position of the reel in the same manner it does during the operation of the machine in normal play. The odds assigned each reel position are recorded in a read/write electronic security device, overwriting any previously recorded odds. The read/write device is capable of maintaining the information without being connected to a power source. Such a read/write device may be an electromagnetic storage device such as a computer disk, optomagnetic disks, EEPROM, Flash Memories, or other memory devices well known in the art.

Access to the special recognition mode is security protected. Such protection could include an electronic key, external communication that is password protected, a special setting program or the like. Therefore, there exists the ability to change the odds by those who have authority, i.e., access to the special recognition mode while at the same time preventing unauthorized alteration of the odds.

The read/write device is also secured, preferably in a sealed and locked box to protect it from physical tampering. In addition, the information in the read/write device is preferably stored in an encrypted fashion. Appropriate encryption algorithms, such as Data Encryption Standard ("DES"), are well-known in the art. This provides a farther measure of protection from electronic tampering.

With the security system of the present invention, unless a technician has access to the special recognition mode he cannot alter the machine from a functional standpoint. Thus, if a technician changes out any hardware as part of maintenance, then the machine will function the same or not function at all.

The read/write device can be used for purposes other than securing the parameters of the machine. In addition to the odds information, the read/write device could also be used to store other information relevant to the machine such as a machine identifier, the machine denomination, the win table identifier and accounting information, i.e., coins in, coins out, games played, and the like.

Once the odds information has been recorded into the security device, if the odds of the machine are altered without authorization the machine will cease to function until the recorded odds are restored. The machine is programmed to check the odds on either a continuous basis or a periodic basis. In a preferred embodiment, the machine checks the odds every time the door of the machine is closed, every time the machine is powered up, every time a "reset button" is pushed and after any time the machine has been in "Out of Order" mode. If the check results in a failure to match, then the machine goes into an "Out of Order" mode and will not function as a game until the odds are restored.

Figure 7:
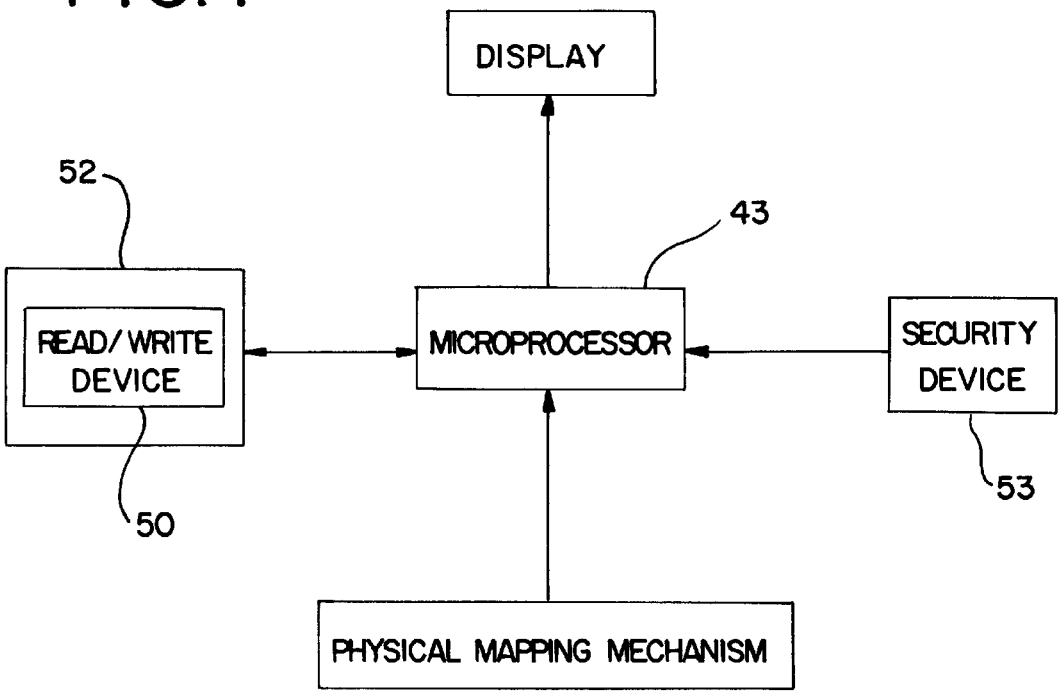
FIG. 7 is a block diagram showing the operation of the security system of the present.

FIG. 7 provides a block diagram of the security system in the present invention. The read/write device 50 is located in box 52. The read/write device 50 is associated with the microprocessor 43 in manner that the microprocessor can write odds to the read/write device only when in the special recognition mode. The machine is further fitted with a security device 53 that enable an authorized technician to put the machine into the special recognition mode. If access to the special recognition mode is controlled by an electronic key this security device 53 would be a key reader. Alternatively, if the special recognition mode is password protected the security device 53 could be a keypad that allows entry of the password or a port that allows a data entry device to be attached.

In operation, if the parameters of the machine are to be altered, the machine is put into special recognition mode by activating the security device 53. At that point the microprocessor 43 activates the gaming machine causing the reels 10 to rotate and the sensor 28 to read the information on the markers 34 associated with each reel stop position 22. This information is then written to and stored in the read/write device 50. The machine is then taken out of the special recognition mode and the information is locked until next time the machine put in special recognition mode.

With this system a technician can effect repairs to the gaming machine without having to enter the special recognition mode. For example, if a motor needed to be replaced a technician could do so and he would not have the ability to alter the operational parameters of the machine. The technician can be allowed to all the electronic or mechanical parts except the read/write device without having to enter the special recognition mode. As long as his activity does not change the odds of a particular reel stop position being selected, these repairs will not affect the operation of the machine. Thus, when simple repairs are made there is greater security. If however, the technician should affect a change that does alter the parameters of the machine, such as change out a strip 30, then the read/write device 50 in conjunction with the microprocessor 43 would detect the change and put the game into "Out of Order" mode. The machine can then be made to display an out of order signal but it will not operate as a gaming machine until the change is corrected.

Although the present invention has been described with respect to the preferred embodiments, it not so limited, as changes and modifications may be made which are within the fully intended scope of the invention as defined by the following claims.

I claim:

1. A gaming machine comprising:

a reel defining a plurality of reel stop positions, each reel stop position associated with an indicia that can be displayed on a win line when the associated reel stop position is selected;

means for controlling the probability of the reel stop position being selected, said means physically associated with each reel stop position such that probability of at least one reel stop position being selected is different than at least one other reel stop position;

means for rotating the reel about an axis;

means for stopping the reel such at the selected reel stop position such that the associated indicia is displayed on the win line; and a security system preventing the unauthorized alteration of the means for controlling the probability of a reel stop position being selected by providing an indication that an unauthorized alteration of the probability of a reel stop position has been made.

2. The gaming machine of claim 1 wherein the means for controlling the probability comprises:

an optical marker containing value information physically associated with each reel stop position;

means for reading the value information contained on the optical marker;

a mechanism for summing the value information read by the means for reading until a target sum is reached; and a random number generator for generating a number that defines the target sum, whereby the reel stop position at which the sum of the value information reaches the target sum is selected and the associated indicia is displayed on the win line.

3. The gaming machine of claim 2 wherein the optical marker is a bar code and the means for reading is a bar code reader.

4. The gaming machine of claim 2 wherein the mechanism for summing is a microprocessor.

5. The gaming machine of claim 2 wherein the optical markers are contained on a replaceable strip that is mounted on the inner periphery of the reel and the means for reading is positioned in internal to the circumference of the reel so that it can read the information on the optical markers.

6. The gaming machine of claim 5 wherein the means for reading is in a fixed position and the optical markers move past the means for reading.

7. The gaming machine of claim 2 wherein the random number generator generates a number from a range of numbers equal to an integer multiple of the total sum of the values contained in all the optical markers.

8. The gaming machine of claim 1 wherein the means for controlling the probability comprises:

an outer magnet associated with each of the reel stop positions such that the outer magnets move through a path consistent with the rotation of the reel and where at least two of the outer magnets are of a different level of magnetism, said outer magnets being oriented such that their polarity is consistently positioned with respect to the reel;

a fixed magnet mounted in close proximity to the path of the outer magnets and oriented such that its polarity is opposite that of the outer magnets and there is an attracting force between the two, whereby as the outer magnets pass the fixed magnet a breaking torque is applied to the reel.

9. The gaming machine of claim 8 wherein the outer magnets are permanent magnets and at least two of the outer magnets are different in size.

10. The gaming machine of claim 8 wherein the fixed magnet is a permanent magnet.

11. The gaming machine of claim 8 where in the outer magnets are removably affixed to the inner periphery of the reel so as to rotate with the reel and the fixed magnet is positioned internal to the circumference of the reel.

12. The gaming apparatus of claim 1 wherein the security system comprises a read/write device that stores the probability of each reel stop position being selected;

a system for monitoring the probability of each reel stop position each being selected and comparing it with the information stored in the read/write device; and means for rendering the machine inoperable if the probability of each reel stop position being selected does not match the information stored in the read/write device.

13. The gaming apparatus of claim 12 wherein the read/write device does not require electrical power to retain the stored information.

14. The gaming apparatus of claim 12 wherein the read/write device is located in a sealed locked box.

15. A gaming machine comprising:

a game display defining a plurality of stop positions;

a driving mechanism for causing the rotation of the display around at least one axis;

a mechanism for controlling the probability of a stop position being selected for display, said mechanism being physically associated with the stop positions, such that the probability of displaying at least one position is different than displaying in at least one other position;

a mechanism for stopping the game display such that the selected stop position is displayed: and a security system for preventing the unauthorized tampering of the mechanism for controlling the probability of a stop position being selected by providing an indication that an unauthorized alteration of the probability of a reel stop position has been made.

16. The gaming machine of claim 15 wherein the game display is a reel.

17. The gaming machine of claim 15 wherein the game display is a rotating tape.

18. The gaming machine of claim 15 wherein the mechanism for controlling the odds probability comprises:

an optical marker containing value information physically associated with each reel stop position;

means for reading the value information contained on the optical marker;

a mechanism for summing the value information read by the means for reading until a target sum is reached; and a random number generator for generating a number that defines the target sum, whereby the reel stop position at which the sum of the value information reaches the target sum is selected and the associated indicia is displayed on the win line.

19. The gaming machine of claim 18 wherein the optical marker is a bar code and the means for reading is a bar code reader.

20. The gaming machine of claim 18 wherein the mechanism for summing is a microprocessor.

21. The gaming machine of claim 18 wherein the optical markers are contained on a replaceable strip that is mounted on the inner periphery of the reel and the means for reading is positioned in internal to the circumference of the reel so that it can read the information on the optical markers.

22. The gaming machine of claim 18 wherein the means for reading is in a fixed position and the optical markers move past the means for reading.

23. The gaming machine of claim 18 wherein the random number generator generates a number from a range of numbers equal to an integer multiple of the total sum of the values contained in all the optical markers.

* * * * *